US008834324B2

(12) United States Patent
Lull

(10) Patent No.: US 8,834,324 B2
(45) Date of Patent: Sep. 16, 2014

(54) EXERCISE BICYCLE WITH MECHANICAL FLYWHEEL BRAKE

(75) Inventor: Andrew P. Lull, Boulder, CO (US)

(73) Assignee: Foundation Fitness, LLC, Portland, OR (US)

( * ) Notice: Subject to any disclaimer, the term of this patent is extended or adjusted under 35 U.S.C. 154(b) by 235 days.

(21) Appl. No.: 13/267,655

(22) Filed: Oct. 6, 2011

(65) Prior Publication Data

US 2012/0088637 A1 Apr. 12, 2012

Related U.S. Application Data

(60) Provisional application No. 61/390,570, filed on Oct. 6, 2010, provisional application No. 61/390,572, filed on Oct. 6, 2010, provisional application No. 61/390,577, filed on Oct. 6, 2010.

(51) Int. Cl.

| | |
|---|---|
| ***A63B 21/00*** | (2006.01) |
| ***A63B 21/012*** | (2006.01) |
| ***A63B 21/015*** | (2006.01) |
| ***A63B 21/22*** | (2006.01) |
| ***A63B 22/06*** | (2006.01) |

(52) U.S. Cl.

CPC ..... *A63B 21/015* (2013.01); *A63B 21/225* (2013.01); *A63B 21/00069* (2013.01); *A63B 22/0605* (2013.01); *A63B 21/1496* (2013.01)

USPC ..... 482/63; 482/65; 482/57; 482/15

(58) Field of Classification Search

USPC ..... 482/63, 64, 65, 57, 118, 114, 115, 119

See application file for complete search history.

(56) References Cited

U.S. PATENT DOCUMENTS

| | | | | |
|---|---|---|---|---|
| 5,031,901 | A * | 7/1991 | Saarinen | 482/63 |
| 5,466,203 | A * | 11/1995 | Chen | 482/63 |
| 7,314,434 | B2 * | 1/2008 | Chen | 482/63 |

* cited by examiner

*Primary Examiner* — Jerome w Donnelly
(74) *Attorney, Agent, or Firm* — Polsinelli PC

(57) ABSTRACT

An exercise bicycle including a frame supporting a wheel such as a flywheel. A brake assembly (or resistance assembly) including a brake arm is pivotally coupled with the frame. The brake arm assembly includes a brake pad engaging the flywheel to alter the power needed to rotate the flywheel during exercise. A brake adjustment assembly is operably coupled with the brake arm. The adjustment assembly includes a shaft rotatably supported on the frame and mounted to be translated toward the flywheel while being restricted from translating away from the flywheel. A spring is positioned between the threaded shaft and the brake arm whereby rotation of the shaft increases or decreases compression of the spring thereby increasing or decreasing a frictional force between the brake pad and the flywheel.

18 Claims, 10 Drawing Sheets

EXERCISE BICYCLE WITH MECHANICAL FLYWHEEL BRAKE

CROSS REFERENCE TO RELATED APPLICATION

The present non-provisional utility application claims priority under 35 U.S.C. §119(e) to U.S. Provisional Patent Application No. 61/390,572 titled "Exercise Bicycle with Mechanical Flywheel Brake," filed on Oct. 6, 2010, which is hereby incorporated by reference herein.

The present non-provisional utility application also claims priority under 35 U.S.C. §119(e) to U.S. Provisional Patent Application Nos. 61/390,570 and 61/390,577 titled "Exercise Bicycle Frame with Bicycle Seat and Handlebar Adjustment Assemblies" and "Exercise Bicycle with Magnetic Flywheel Brake", respectively and which were both filed on Oct. 6, 2010, which are hereby incorporated by reference herein.

The present application is also related to utility applications titled "Exercise Bicycle Frame with Bicycle Seat and Handlebar Adjustment Assemblies" and "Exercise Bicycle with Magnetic Flywheel Brake", each of which were filed contemporaneously with the present application on Oct. 6, 2011, and which are hereby incorporated by reference herein.

FIELD OF THE INVENTION

Aspects of the present disclosure involve an exercise bicycle with a mechanical flywheel brake that provides variable braking power.

BACKGROUND

Indoor cycling is a very popular and excellent way for people to maintain and improve fitness. Generally speaking, indoor cycling revolves around an exercise bicycle that is similar to other exercise bicycles with the exception that the pedals and drive sprocket are connected to a flywheel rather than some other type of wheel. Thus, while a user is pedaling, the spinning flywheel maintains some momentum and better simulates the feel of riding a real bicycle. To further enhance the benefits of indoor cycling, fitness clubs often offer indoor cycling classes as a part of their group fitness programs. With such a program, an instructor guides the class through a simulated real world ride including simulating long steady flat sections, hills, sprints, and standing to pedal for extended periods. While numerous different forms of indoor cycles exist, many suffer from common problems. For example, many indoor cycles are hard to adjust in order to provide the proper handlebar height, seat height, and separation between the handlebar and seat for the myriad of different body sizes of the people that might use the indoor cycle. Such difficulties are exaggerated in a group setting or club environment where time is limited and people are constantly adjusting the equipment. Many of these conventional cycles also have inferior flywheel resistance (braking) arrangements where resistance is difficult to fine tune, fades over time, and suffers from other problems.

It is with these issues in mind, among others, that aspects of the present disclosure were conceived.

SUMMARY

One aspect of the present invention involves an exercise bicycle including a frame supporting a flywheel. The exercise bicycle further comprises a frictional brake assembly including a brake arm pivotally coupled with the frame, the brake arm assembly including a brake pad frictionally engaging the flywheel. A brake adjustment assembly is operably coupled with the brake arm, the brake adjustment assembly comprising a threaded shaft rotatably supported on the frame and mounted to be translated toward the flywheel while being restricted from translating away the flywheel, the threaded shaft engaging a threaded collar. A float spring is positioned between the threaded collar and the brake arm. Rotation of the shaft moves the collar closer or further from the flywheel and increases or decreases compression of the float spring thereby increasing or decreasing frictional force between the brake pad and the flywheel.

Another aspect of the present disclosure involves an exercise bicycle including a down tube extending angularly and upwardly from a rear portion to a front portion and a head tube coupled with the front portion of the down tube. The exercise bicycle further includes a fork assembly, supporting a flywheel, extending from a position rearward of the front portion of the down tube to the front support member. A flywheel brake assembly includes a brake arm defining a first portion and a second portion, the first portion coupled with a gusset at a first pivot member, the gusset coupled between the head tube and down tube. The flywheel brake assembly further includes a shaft assembly extending through the down tube to the brake arm and coupled with the brake arm at the second portion and a brake pad coupled with the brake arm between the first portion and the second portion.

The shaft may be rotatably supported on the frame and mounted to be translated toward the flywheel while being restricted from translating away the flywheel, the shaft including a threaded portion engaging a threaded collar. A float spring may be positioned between the threaded collar and the brake arm whereby rotation of the shaft moves the collar closer or further from the flywheel and increases or decreases compression of the spring thereby increasing or decreasing a frictional force between the brake pad and the flywheel.

BRIEF DESCRIPTION OF THE DRAWINGS

The foregoing and other objects, features, and advantages of the present disclosure set forth herein will be apparent from the following description of particular embodiments of those inventive concepts, as illustrated in the accompanying drawings. It should be noted that the drawings are not necessarily to scale; however the emphasis instead is being placed on illustrating the principles of the inventive concepts. Also, in the drawings the like reference characters refer to the same parts or similar throughout the different views. It is intended that the embodiments and figures disclosed herein are to be considered illustrative rather than limiting.

DETAILED DESCRIPTION

Figure 1:
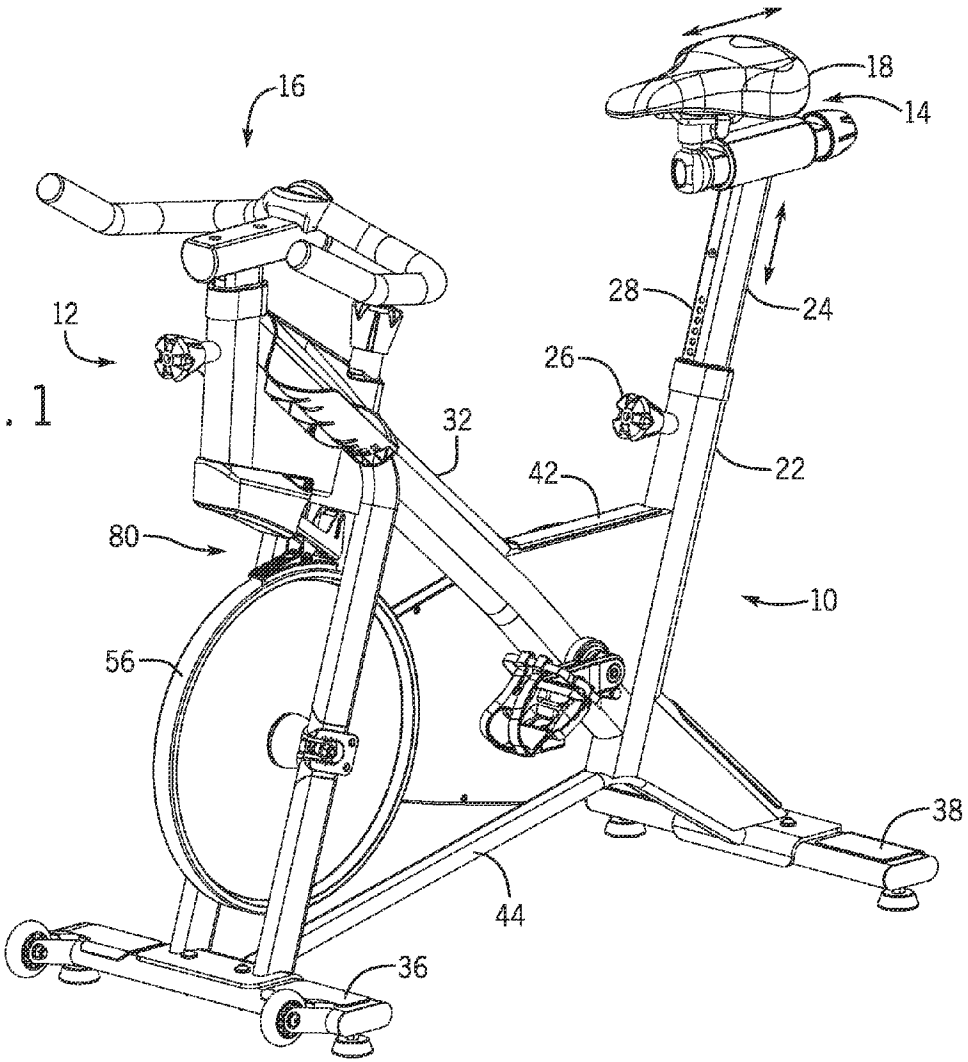
FIG. 1 is an isometric view of an exercise bicycle.
Figure 2:
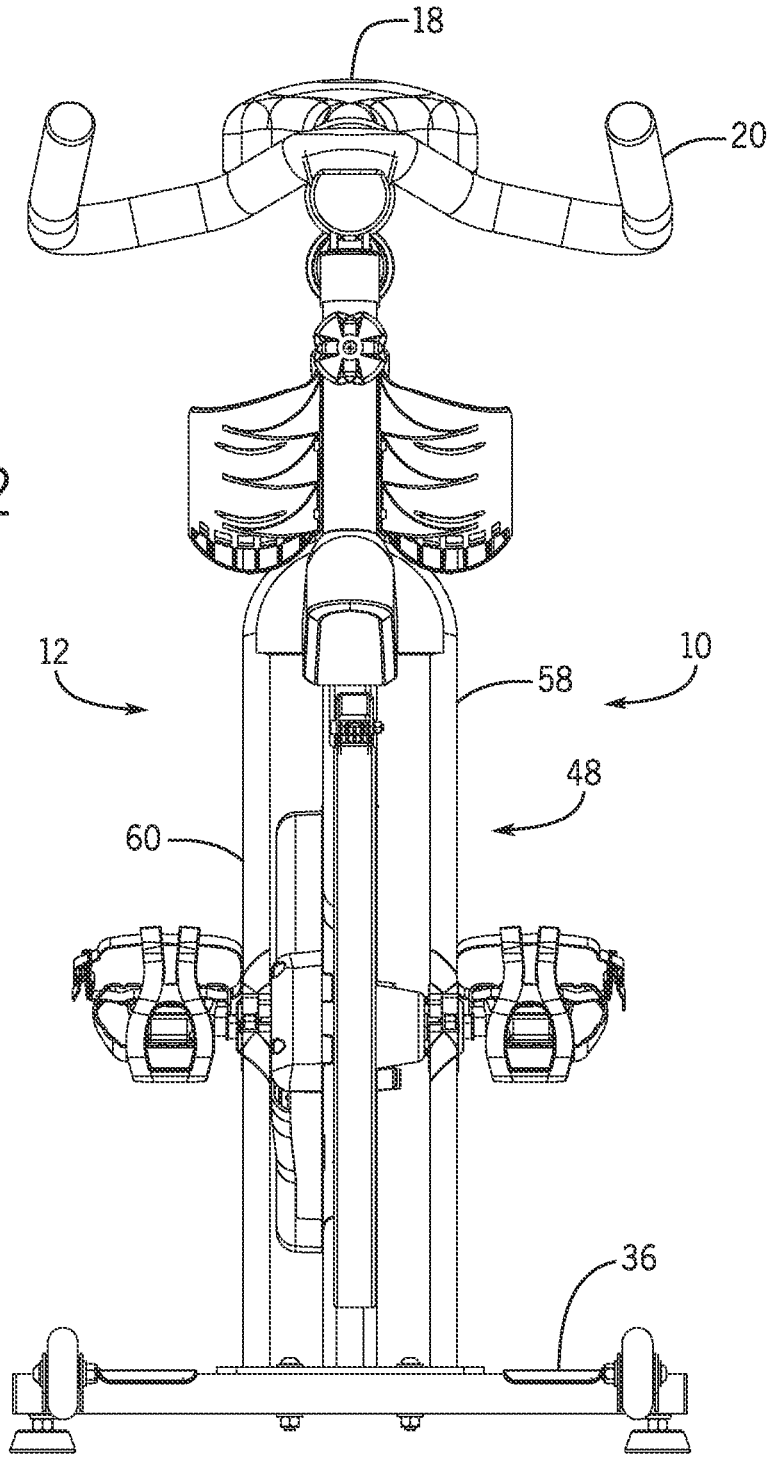
FIG. 2 is a front view of the exercise bicycle shown in FIG. 1.
Figure 3:
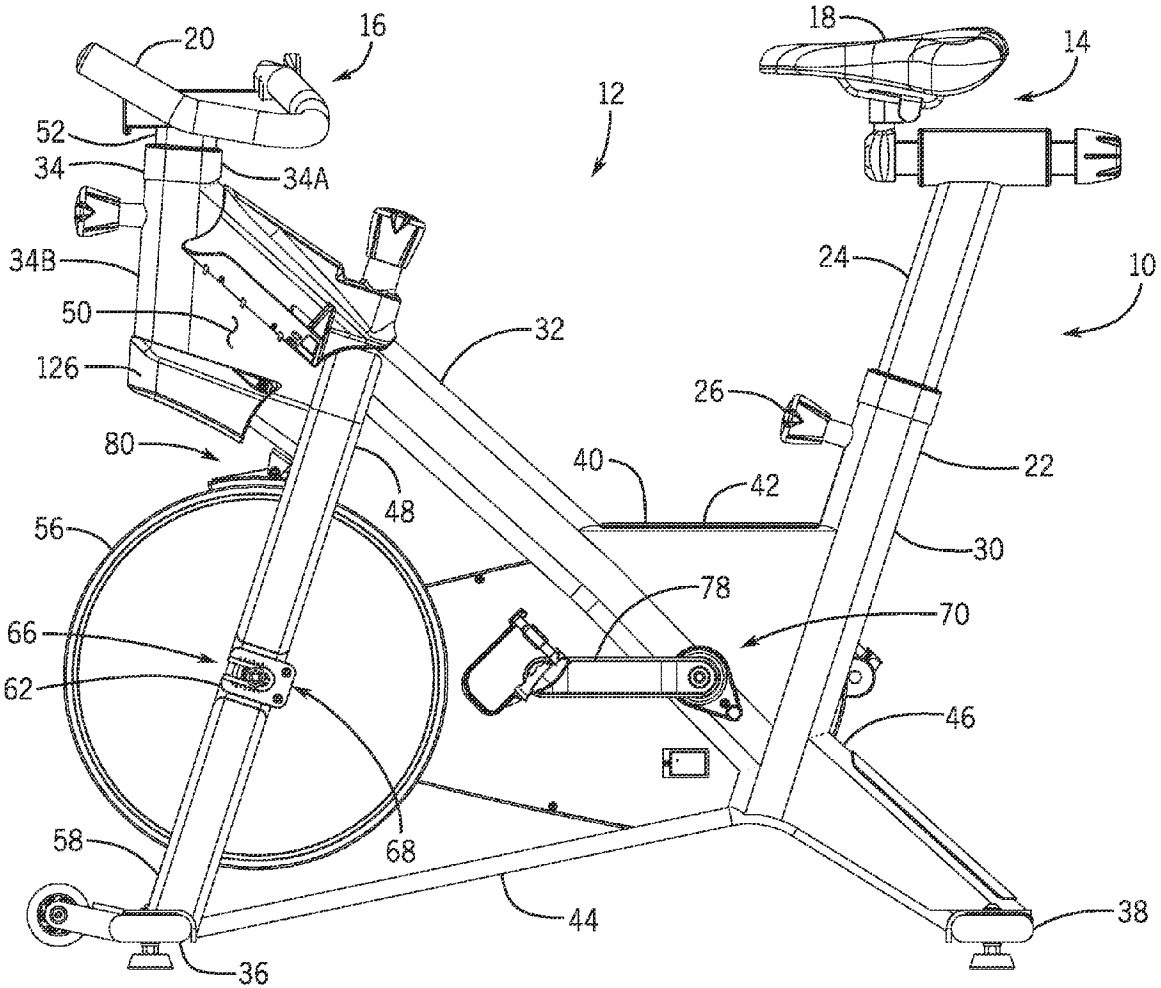
FIG. 3 is a left side view of the exercise bicycle shown in FIG. 1.
Figure 4:
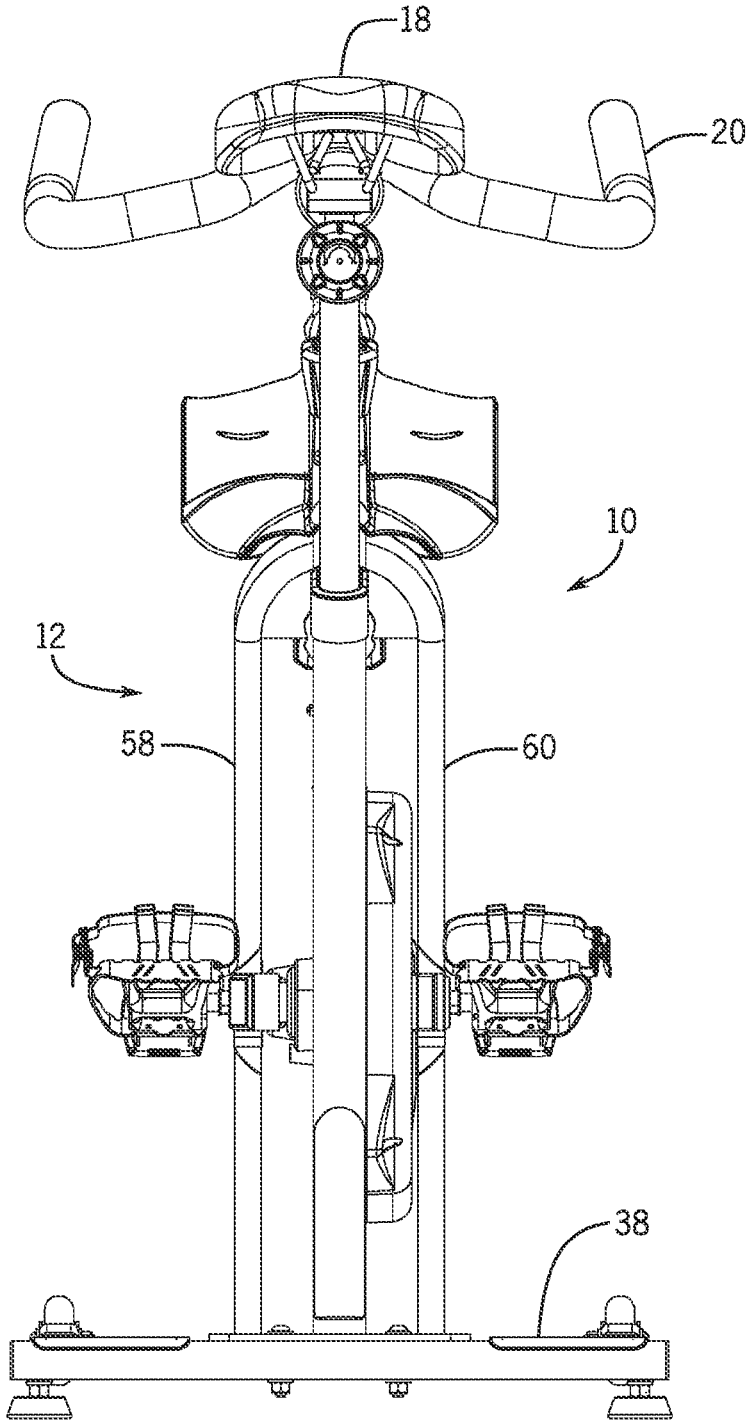
FIG. 4 is a rear view of the exercise bicycle shown in FIG. 1.
Figure 5:
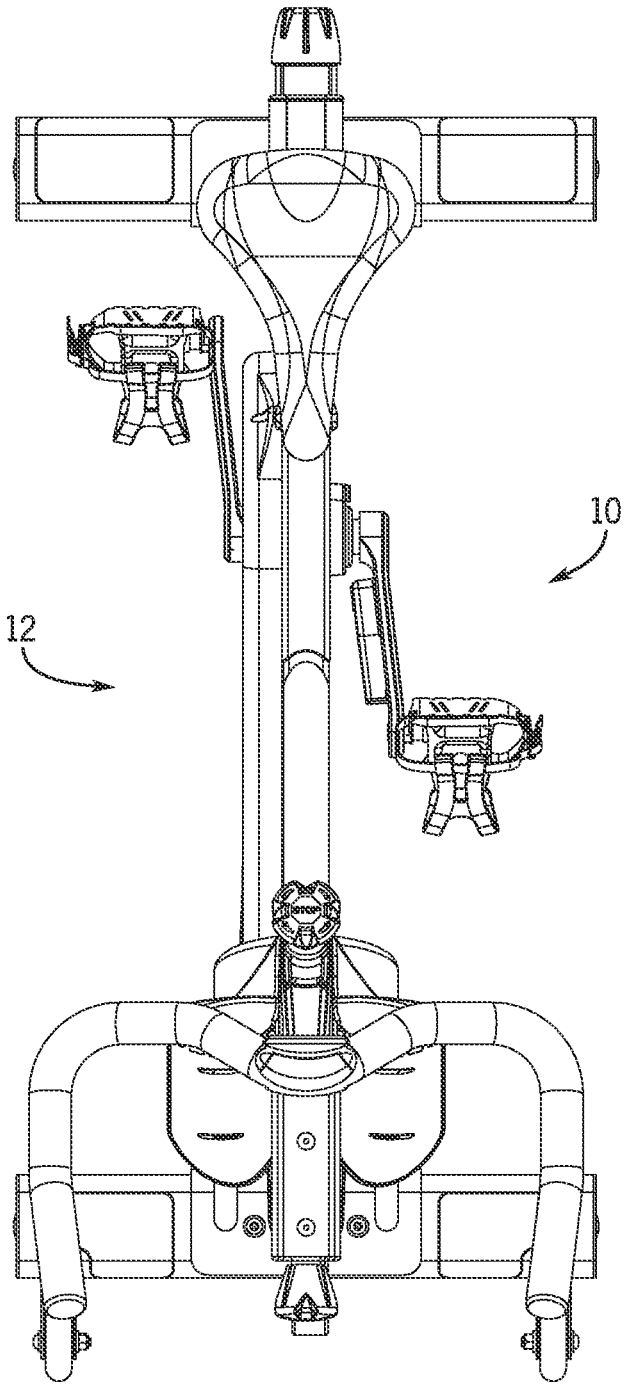
FIG. 5 is a top view of the exercise bicycle shown in FIG. 1.

Aspects of the present disclosure involve an exercise bicycle including a flywheel in an indoor cycling configuration. The exercise bicycle includes a mechanical flywheel brake by which a rider may finely tune any resistive forces applied to the flywheel. The frame design provides exceptional space between the seat, handlebars and frame members, while maintaining industry standard dimensioning for proper rider use of the exercise bicycle. For example, the head tube is positioned forward of the handlebars and eliminated as a point of contact for a rider, and the down tube is low providing excellent step-over height.

Referring now to FIGS. 1-6, one example of an exercise bicycle 10 is shown. The exercise bicycle is configured for use by a variety of riders in a club environment or for a single or limited number of riders in a home or other personal use environment. The exercise bicycle includes a frame 12 adjustably supporting an adjustable seat assembly 14 at the rear of the frame and adjustably supporting an adjustable handlebar assembly 16 at the front of the frame. The adjustable seat and handlebar assemblies provide fore and aft adjustment of a respective seat 18 and handlebar 20. Further, the seat and handlebar assemblies may be vertically adjusted and fixed at various possible positions. The frame illustrated herein has a handlebar structure that may be moved vertically but not fore and aft. It is possible to use the same the same type of fore and aft adjustment on the handlebar. Moreover, for both the seat and handlebar assemblies it is possible to use other forms of fore and aft adjustment. Hence, the exercise bicycle provides for many different possible seat and handlebar positions to fit different riders and to provide riders with different configurations depending on the exercise being performed.

The frame includes a seat tube 22 that receives a seat post portion 24 of the seat assembly 14. The seat post may be moved up and down relative to the seat tube to adjust the height of the seat assembly, and particularly to adjust the height of the seat 18 that is a part of the seat assembly. A pop pin 26 is connected with the seat tube and is configured to engage one of a plurality of apertures 28 defined in the seat post, and thereby secure the seat at a desired height. The pop pin may be spring-loaded such that it is biased in the locked position engaging the aperture.

The pop pin is shown extending forwardly from the seat tube. This configuration provides easy access for a rider to move the seat up or down during exercise. For example, indoor cycling classes often include some time where the user is standing and pedaling rather than seated, and at such times the rider may move the seat to a lower position. The pop pin is positioned for easy access by the rider. It is possible, however, to position the pop pin on the back side of the seat tube or at another location. Additionally, it is possible to use other mechanisms to facilitate seat height adjustment with or without pop pins. For example, a pawl on the fore and aft seat and handlebar assemblies may be used to vertically adjust the seat post (or tube) as well as the handlebar post.

In one particular implementation, the seat tube is rearwardly angled at approximately 72 degrees. The seat tube angle, along with other adjustment and dimensional relationships discussed herein, is optimized so that riders of all sizes can best fit the exercise bicycle. The seat tube 22, along with other frame members discussed herein, is extruded aluminum and defines a racetrack-shaped cross section 30 with opposing flat side walls 30A and opposing semicircular side walls 30B. The seat post 24 defines a substantially matching racetrack-shaped cross section of a smaller dimension in order to fit within the seat tube. Other frame member shapes and materials may be used, such as steel square tubing or steel round tubing, in the construction of the frame assembly. However, the extruded aluminum racetrack shaped tubing provides a unique balance between strength, overall exercise bicycle weight and aesthetic appearance. Additionally, while the seat post is shown as telescoping out of the seat tube, this relationship may be reversed such that the post fits over the tube. This relationship may also be reversed for other tube and post arrangements discussed herein.

Returning again to the discussion of the frame 10, a down tube 32 extends from a lower rear area of the exercise bicycle to an upper forward area of the exercise bicycle. Particularly, the down tube extends between a bottom portion of the seat tube 22 and a head tube 34. The down tube is also a racetrack type extruded aluminum member. The down tube, in one particular arrangement, is at angle of about 42 degrees. The angular relationship of the down tube may be measured relative to a horizontal surface upon which the exercise bicycle sits or relative to a line between a front support member 36 and a rear support member 38. The down tube is welded to the bottom of the seat tube, although other means of attachment and arrangements are possible. Further, a triangular rear gusset 40 with a substantially flat top 42 is connected to and above the intersection of the seat tube 22 and the down tube 32. The rear gusset, like other frame members and arrangements, may be altered or removed. In the exercise bicycle frame illustrated, the gusset provides structural support to the seat tube and seat assembly, and also provides a step for riders mounting the exercise bicycle as well as other advantages. In the example shown, the flat top portion of the gusset, which provides the step, is slightly longer than 10 inches measured between the seat tube and down tube, a dimension not achievable by other designs which employ different frame configurations, larger flywheels and different gearing configurations.

A brace 44 extends from the rear support member 38 upward to the bottom of the seat tube 22 and then forward and downward to the front support member 36. A lower gusset 46 is connected between the rear portion of the brace, the top of the rear support member 44, and the lower rear portion of the seat tube 22. The lower gusset is in substantial alignment and of substantially similar dimension as the down tube. The front support member 36 is connected to the front forks 48 and extends outwardly and transversely from each fork.

The head tube 34 is connected to the front of the down tube 32. A portion 34A of the head tube extends upwardly from the down tube and a portion 34B of the head tube extends downwardly from the head tube. A front gusset 50 is connected between the downwardly extending portion 34B of the head tube and the down tube 32. The head tube receives a handlebar post 52 that extends downwardly from the fore and aft adjustable handlebar assembly 16. The handlebar post may be moved vertically relative to the head tube to adjust the height of a handlebar assembly, and particularly to adjust the height of a handlebar 20 of the handlebar assembly. A second pop pin 54 is connected with the head tube 34 and is configured to engage one of a plurality of apertures (not shown) defined in the handlebar post, and hence secure the handlebars at a desired height. Other mechanisms may also be used in place of the pop pin, and the position of the pop pin or any other mechanism may be altered in alternative exercise bicycle implementations.

In the frame configuration illustrated herein, the front fork assembly 48, which supports a flywheel 56 between opposing left 58 and right 60 fork legs, is coupled to the down tube 32 at a point between the head tube 34 and the seat tube 22. In the particular arrangement shown, the down tube is about 561 mm between the rear of the head tube and the intersection between the rear gusset 40 and the down tube, and the fork is about 315 mm between the rear of the fork and the same intersection.

In the frame configuration shown, the forks are set at about the same angle as the seat tube. A pair of mounting brackets 62, also referred to as "drop outs", is integrated in the fork legs to support a flywheel axle 64 and the flywheel. The exercise bicycle discussed herein is particularly configured for indoor cycling and therefore includes the flywheel. It is nonetheless possible to deploy the frame and other components discussed, whether alone or in combination, in an exercise bicycle that does not include a flywheel. The drop outs have matching forwardly opening channels 66 that are perpendicular to the long axis of the fork legs, in one embodiment. Thus, the forward opening of the channels is higher than the rear of the channels. An adjustment screw 68 protrudes into the opening. The design is advantageous in that it allows a user to mount the flywheel from the open front area of the exercise bicycle without any hindrance, such as if the channels opened rearwardly. Moreover, the channels receive the axle and support the flywheel while a user adjusts the axle position by way of the adjustment screws to tension the chain and center the flywheel, such as during assembly or maintenance. It is also possible to orient the channels in other ways, such as horizontally and level, and include a lip or other retaining member at the opening of the channel to help retain the flywheel before the axle is locked in place.

In many conventional exercise bicycle designs, the head tube is aligned with the forks. The exercise bicycle shown herein, however, has the head tube positioned at the front of the frame and forward of the fork. In many conventional designs, the handlebars are above and forward the head tube and the head tube is the rearward most component.

The frame assembly 12 further includes a crank assembly 70 configured to drive the flywheel 56. The drive sprocket is rotably supported in a bottom bracket 55 supported in the down tube 32. In one example, the crank assembly includes a single drive sprocket 72 and the flywheel similarly includes a single flywheel sprocket 74 of a smaller diameter than the drive sprocket. A chain 76 connects the drive sprocket to the flywheel sprocket, although other mechanisms, such as a belt, may be used to connect the sprockets. The drive sprocket is fixed to a pair of crank arms 78 and the flywheel is fixed to the flywheel sprocket such that the drive sprocket and flywheel sprocket do not freewheel. Hence, with reference to FIG. 6B, clockwise rotational force on the crank arms, such as in conventional forward pedaling, rotates the flywheel in a clockwise manner. However, if the rider discontinues exerting a pedaling force on the cranks, the spinning flywheel will continue, via the chain, to drive the crank arms. It is, however, possible to include freewheel mechanisms with the drive or flywheel sprocket or other components.

In one particular implementation, the drive sprocket 72 includes 72 teeth and the flywheel sprocket 74 includes 15 teeth. A range of sprocket teeth counts are possible such as 70-74 teeth and 13 to 17 teeth, and an even broader range of 45 to 75 teeth on the drive sprocket. Moreover, depending on the design, other sprocket arrangements are possible, as well as arrangements with a derailleur and multiple sprockets at both ends. This particular sprocket arrangement facilitates the use of a smaller flywheel 56 of 430 mm radius, relative to other designs. With a smaller flywheel, a shallower down tube angle (e.g. 42 degrees) is possible providing a larger gusset step size (e.g. 10 inches) and a larger area between the seat and handlebar assemblies relative to other exercise bicycle frame designs.

Figure 6A:
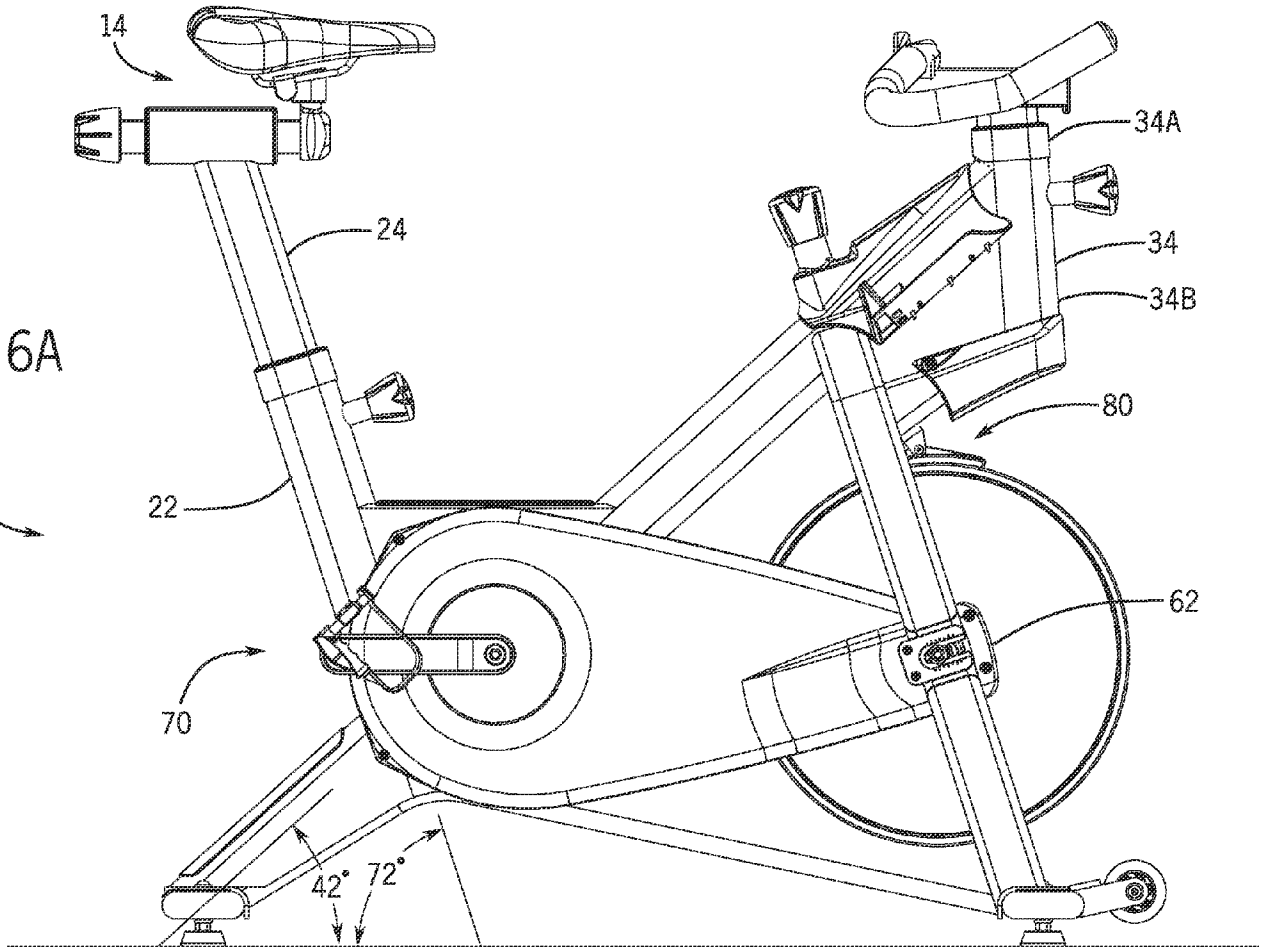
FIG. 6A is a right side view of the exercise bicycle shown in FIG. 1.
Figure 6B:
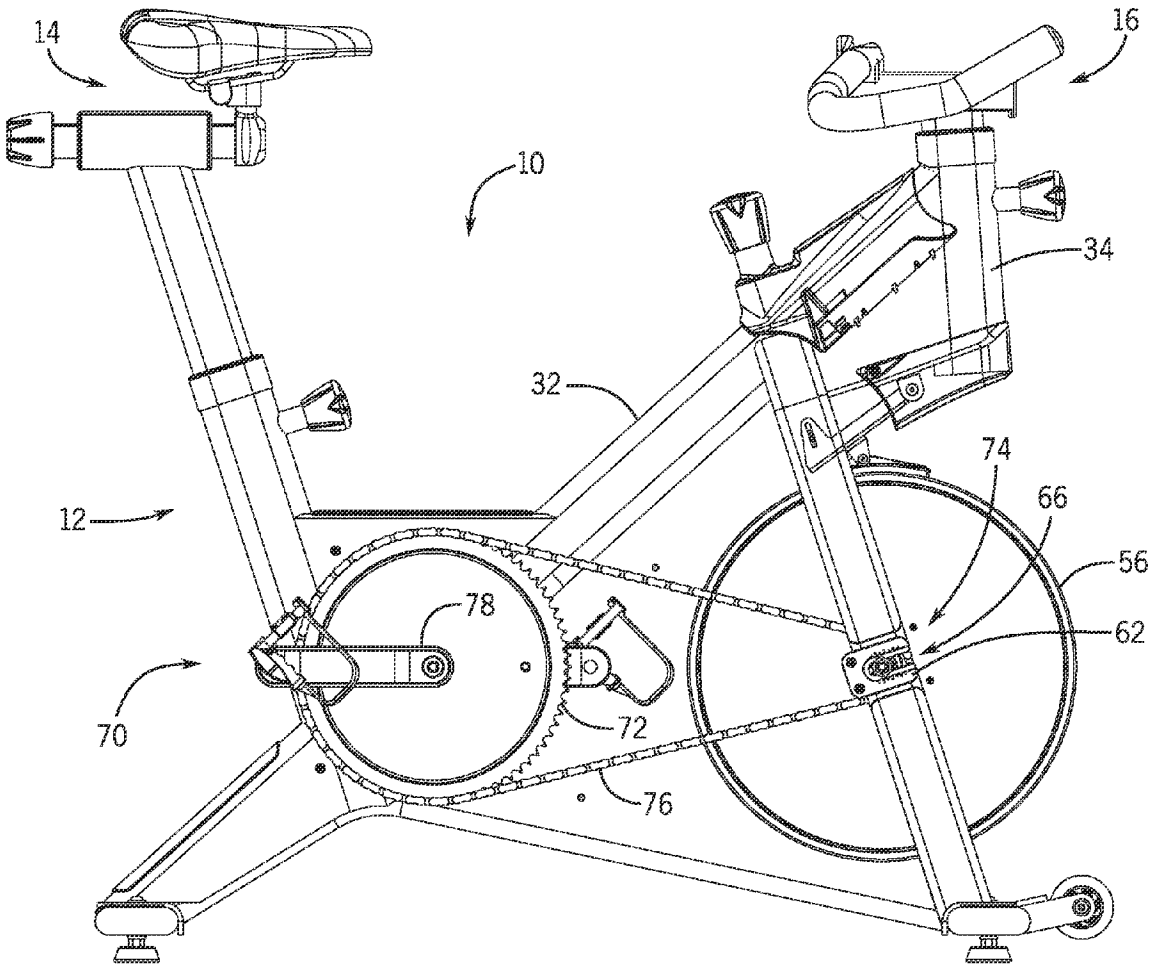
FIG. 6B is a right side view of the exercise bicycle shown in FIG. 1 with a chain guard removed to illustrate a drive sprocket and a flywheel sprocket, along with a chain connected therebetween, and with the right side fork shown in transparent to show mechanical braking components.
Figure 7:
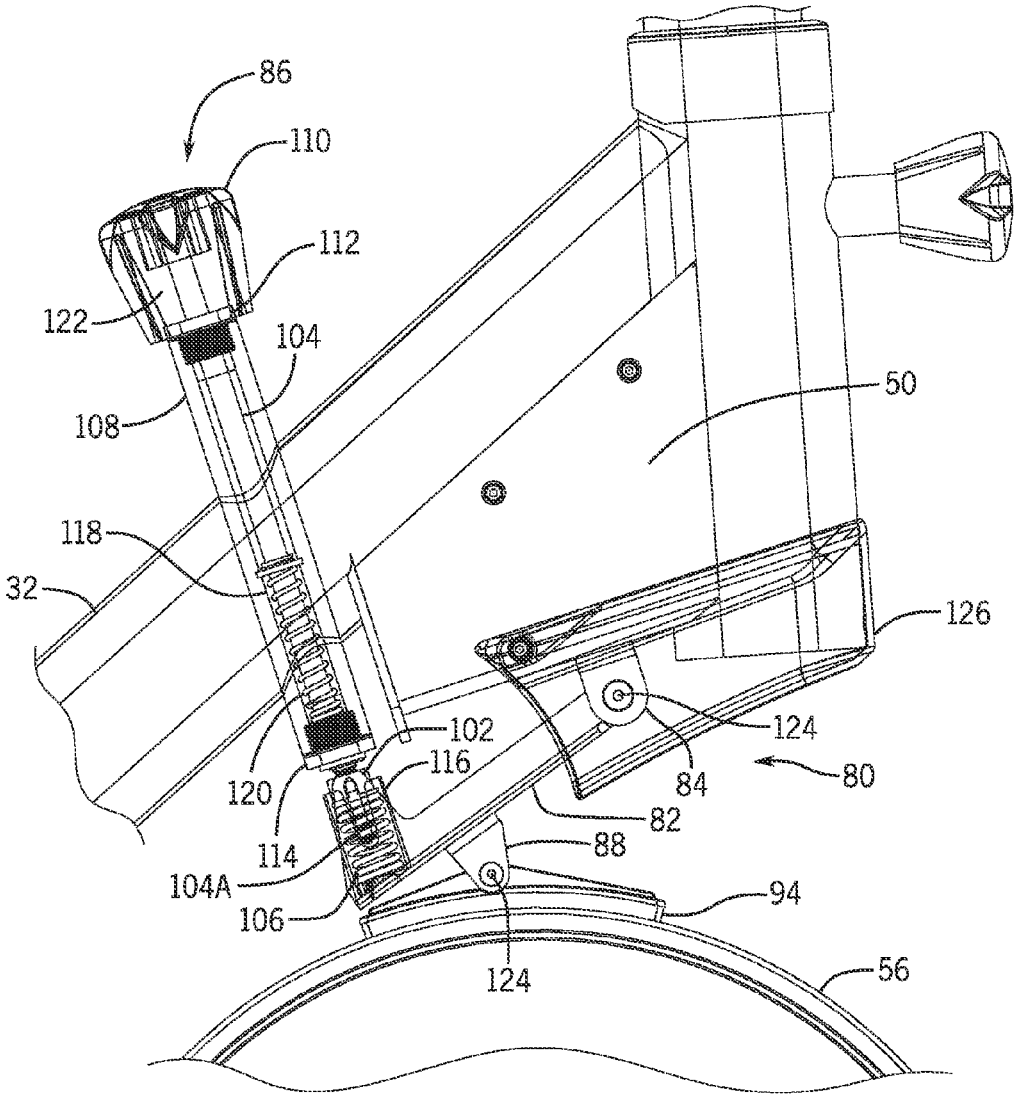
FIG. 7 is a side view a portion of the exercise bicycle shown in FIG. 1, and with some components removed or shown in transparent view to show mechanical braking assembly components.
Figure 8:
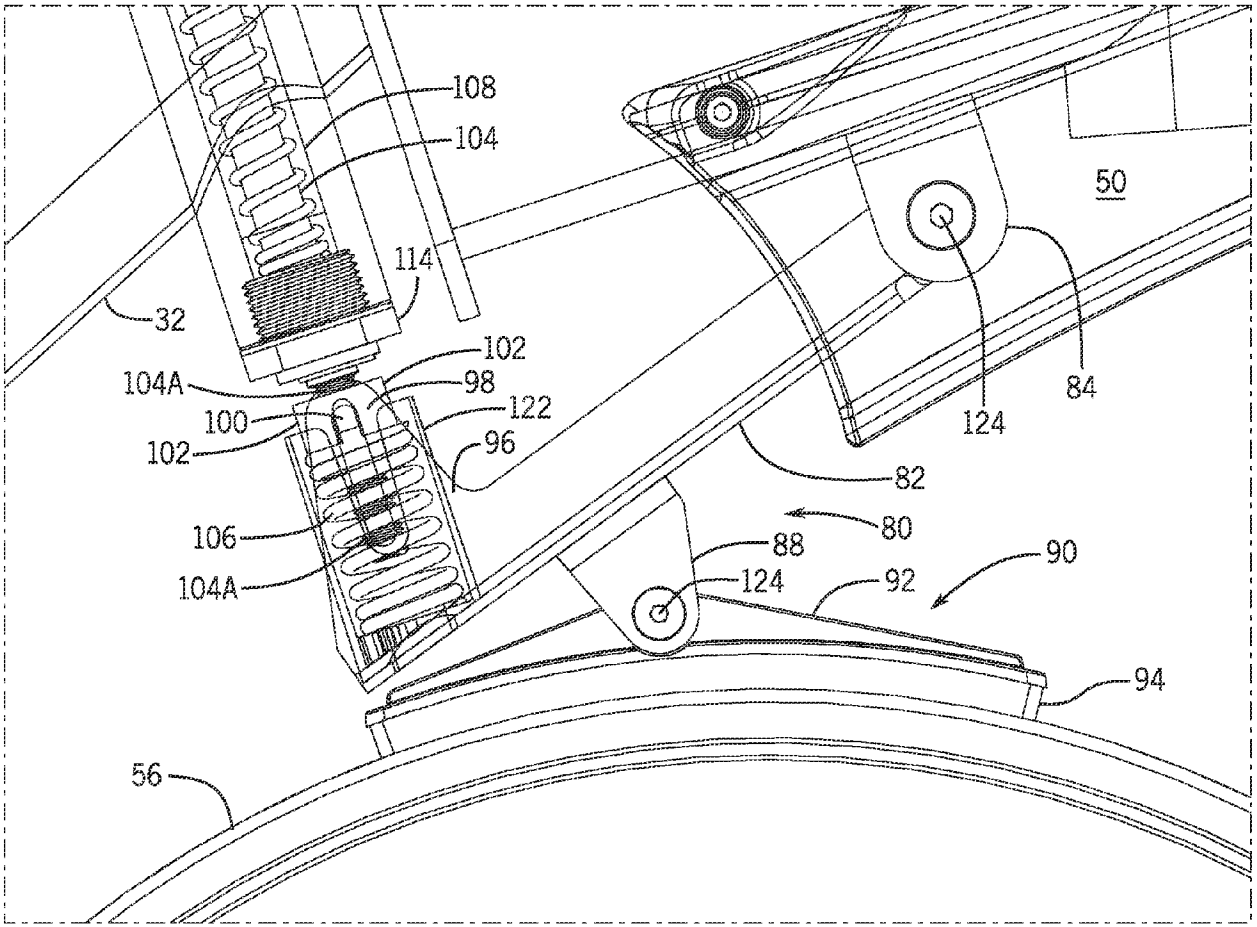
FIG. 8 is a side view a portion of the exercise bicycle shown in FIG. 1, and with some components removed or shown in transparent view to show mechanical braking assembly components.
Figure 9:
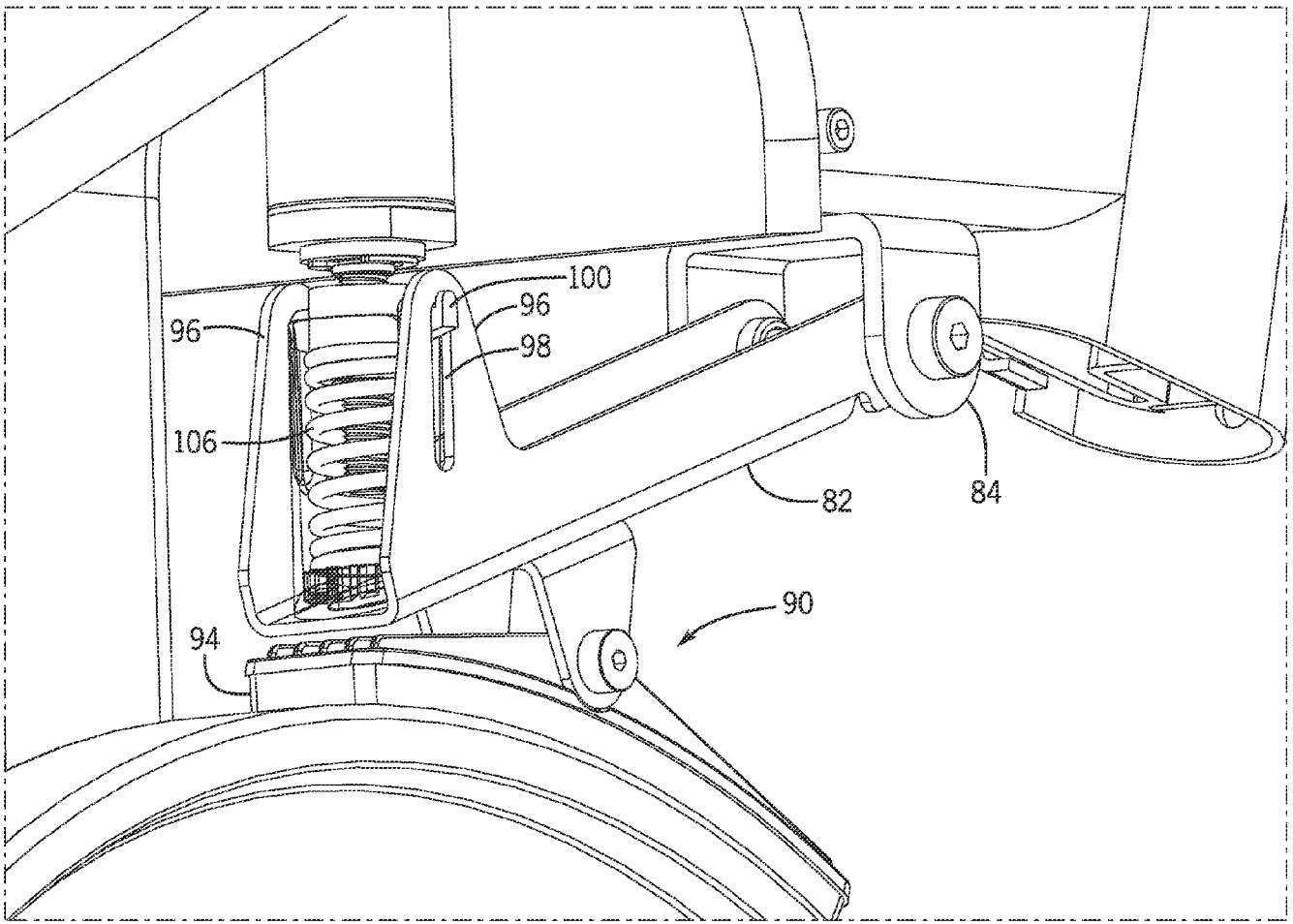
FIG. 9 is an isometric view of a portion of the exercise bicycle shown in FIG. 1, and with some components removed or shown in transparent view to shown mechanical braking assembly components.

The exercise bicycle shown herein includes an adjustable resistance frictional brake 80 illustrated in FIGS. 6-8, as well as others. In one particular implementation, the frictional brake includes a brake arm 82 pivotally mounted at a u-bracket 84 connected to the front gusset 50. The brake arm extends rearwardly and downwardly from the pivot 124. A shroud 126 covers the u-bracket 84 and a proximal portion of the brake arm 82 and is connected to the front gusset 50. Distal from the pivot 124, a brake force adjustment mechanism 86 is coupled with the brake arm. At a point between the ends of the brake arm, a second u-bracket 88 is attached to the brake arm. A brake pad assembly 90 is pivotally mounted to the brake arm at the second u-bracket. The brake pad has a curved brake pad cover 92 that supports a brake pad 94. The brake pad may be felt, plastic, or other material. The curve of the brake pad cover and pad connected to the cover matches an outer radius of the flywheel 56 that the brake pad engages. To increase or decrease flywheel spinning resistance, the brake pad 94 is forced down on the flywheel with greater or lesser force by way of the brake arm 82.

The force on the brake arm relative to the flywheel may be adjusted by way of the brake adjustment assembly 86 operably coupled to the brake arm. The rearward end portion of the brake arm includes a pair of upwardly extending wings 96. Each wing defines a slot 98 that receives arms 100 attached to a threaded collar 102. As a threaded shaft 104 is turned in the collar, the collar is prohibited from spinning by the arms secured in the slots. Accordingly, rotation of the threaded shaft moves the collar toward or away from the flywheel. As discussed below in more detail, a float spring 106 is positioned between the collar and the brake arm to apply force on the brake arm.

The brake adjustment assembly is supported in a tube 108 extending through the down tube 32. The tube is threaded at opposing ends. At the upper end, distal the brake arm, the brake adjustment assembly includes a brake knob 110 fixed to the shaft 104. The shaft is supported in a first bushing 112 threaded into the top of the tube. The shaft extends through the tube and is supported at the opposing end of the tube in a second bushing 114 threaded into the bottom of the tube. The shaft may move relative to the bushings. The threaded portion 104A of the shaft extends from the second, lower, bushing and engages the threaded collar 102.

A clip 116 or shoulder is provided in the portion of the shaft extending from the lower bushing. The clip prevents the shaft form moving upward relative to the bushing. A second clip 118 or shoulder is provided on the shaft above the lower bushing. A spring 120 is positioned between the second clip and the lower bushing. The spring forces the shaft upward within the tube such that the lower first clip abuts the bushing.

A cavity 122 is formed in the knob 110 above the top of the tube. The cavity, in one example, is a slightly larger diameter than the tube 108 and hence the tube fits within the cavity.

To rapidly stop the flywheel 56, a rider may press downward on the knob 110 which moves the shaft 104 downward within the tube 108. The cavity of the knob 110 is pressed downward over the tube 108, albeit only slightly. Further, the shaft 104, through engagement with the brake arm 82 presses downward on the brake pad 94 contacting the flywheel 56 with the force imparted by the rider as increased through the lever action created by the connection of the brake pad assembly between the brake arm pivot 124 and where the shaft 104 imparts force to the brake arm 82. When the rider releases the knob 110 or reduces the force on the knob 110, the spring 120 acting on the upper clip 118, pushes the knob 110 and the shaft 104 upward releasing the force on the brake arm 82 such that the lower clip 116 abuts the bottom of the lower bushing 114.

To finely adjust the braking power applied to the flywheel, a rider may rotate the shaft clockwise or counterclockwise. Since the shaft is configured to rotate but is held in its vertical position by the clips and spring, the threaded portion 104A of the rotating shaft engages the threaded collar 102 to pivot the brake arm upward or downward. Since the brake pad is in contact with the flywheel and the felt does not significantly compress, the brake arm only pivots a minimal amount. Instead, the frictional force between the brake pad and the flywheel is increased or decreased.

The threaded shaft 104A does not directly engage the brake arm 82, although it could. Instead, the shaft extends downward and between the brake arm wings 96. The threaded shaft is coupled with the threaded collar. The float spring 106 is positioned within a cup 122 extending upward from the brake arm. The cup is positioned between the arms extending from the collar and the brake arm. Accordingly, by turning the shaft, the rider moves the collar closer or further from the brake arm. Further the float spring 106 is positioned between the collar 102 and the brake arm 82. The spring compression and force imparted on the brake arm is thereby increased or decreased. Hence, the brake arm and brake pad are pressed against the flywheel with an adjustable force. However, the brake arm and brake pad assembly also float due to the spring 106. Hence, should there be any minor surface variation of the flywheel as it rotates past the brake pad, the brake pad assembly can float over the variation by way of the float spring. Thus, the rider would not sense any resistance variations.

Although various representative embodiments of this invention have been described above with a certain degree of particularity, those skilled in the art could make numerous alterations to the disclosed embodiments without departing from the spirit or scope of the inventive subject matter set forth in the specification. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected to another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. An exercise bicycle comprising: a frame supporting a flywheel; a brake assembly including a brake arm pivotally coupled with the frame, the brake arm assembly including a brake pad engaging the flywheel; a brake adjustment assembly operably coupled with the brake arm, the brake adjustment assembly comprising a threaded shaft rotatably supported on the frame and mounted to be translated toward the flywheel while being restricted from translating away from the flywheel; a float spring positioned between the threaded shaft and the brake arm; and whereby rotation of the threaded shaft increases or decreases compression of the spring thereby increasing or decreasing a frictional force between the brake pad and the flywheel.

2. The exercise bicycle of claim 1 further including a threaded collar receiving the threaded shaft, the threaded collar in a substantially fixed position relative to the threaded shaft whereby rotation of the threaded shaft with the collar increases or decreases compression of the spring thereby increasing or decreasing a frictional force between the brake pad and the flywheel.

3. The exercise bicycle of claim 1 wherein the brake pad is coupled with the brake arm between the brake arm pivotal coupling with the frame and the operable coupling between the brake adjustment assembly and the brake arm.

4. The exercise bicycle of claim 1 wherein the frame comprises a down tube supporting a head tube, the head tube including a section extending above the down tube and a section extending below the down tube, the frame further comprising a gusset coupled between the down tube and head tube, wherein the brake arm is pivotally coupled with the gusset.

5. The exercise bicycle of claim 4 wherein the frame comprises a fork assembly supporting the flywheel, the brake adjustment assembly includes a tube extending through the down tube and translationally and rotatably supporting the threaded shaft including a handle at a first end and a threaded portion supporting the threaded collar at a second end.

6. The exercise bicycle of claim 5 wherein the float spring engages the brake arm and the threaded shaft extends into the float spring but does not engage the brake arm.

7. The exercise bicycle of claim 5 wherein a return spring is fixedly positioned relative to the threaded shaft and biased against a portion of the threaded shaft such that the spring imparts a return force on the threaded shaft when the threaded shaft is translated toward the flywheel so that the brake pad engages the flywheel to stop the flywheel.

8. The exercise bicycle of claim 2 wherein the brake arm includes at least one protrusion defining a channel, the threaded collar including a finger that extends into the channel such that the collar does not rotate when the threaded shaft is rotated thereby causing the threaded shaft to move relative to the collar when the threaded shaft is rotated.

9. The exercise bicycle of claim 1 further including a cup extending from the brake arm, the cup receiving the float spring.

10. An exercise bicycle comprising: a down tube extending angularly and upwardly from a rear portion to a front portion; a head tube coupled with the front portion of the down tube; a fork assembly extending from a position rearward of the front portion of the down tube to the front support member, the fork assembly supporting a flywheel; and a flywheel brake assembly including a brake arm defining a first portion and a second portion, the first portion coupled with a gusset at a first pivot member, the gusset coupled between the head tube and down tube, the flywheel brake assembly further comprising a shaft assembly extending through the down tube to the brake arm and coupled with the brake arm at the second portion and a brake pad coupled with the brake arm between the first portion and the second portion.

11. The exercise bicycle of claim 10 wherein the brake assembly further comprises a brake adjustment assembly coupled with the brake arm, the brake adjustment assembly comprising the shaft rotatably supported on the frame and mounted to be translated toward the flywheel while being restricted from translating away the flywheel, the shaft including a threaded portion engaging a threaded collar; a float spring positioned between the threaded collar and the brake arm; and whereby rotation of the shaft moves the collar closer or further from the flywheel and increases or decreases compression of the spring thereby increasing or decreasing a frictional force between the brake pad and the flywheel.

12. The exercise bicycle of claim 10 wherein the brake pad is coupled with the brake arm between the brake arm pivotal coupling with the gusset and the operable coupling between the brake adjustment assembly and the brake arm.

13. The exercise bicycle of claim 11 wherein the frame comprises a fork assembly supporting the flywheel, the brake adjustment assembly includes a tube extending through the down tube and translationally and rotatably supporting the threaded shaft including a handle at a first end and a threaded portion supporting the threaded collar at a second end.

14. The exercise bicycle of claim 13 wherein the float spring engages the brake arm and the threaded shaft extends into the float spring but does not engage the brake arm.

15. The exercise bicycle of claim 14 wherein a return spring is fixedly positioned relative to the shaft and biased against a portion of the shaft such that the spring imparts a return force on the shaft when the shaft is translated toward the flywheel so that the brake pad engages the flywheel to stop the flywheel.

16. The exercise bicycle of claim 15 wherein the brake arm includes at least one protrusion defining a channel, the threaded collar including a finger that extends into the channel such that the collar does not rotate when the shaft is rotated thereby causing the shaft to move relative to the collar when the shaft is rotated.

17. The exercise bicycle of claim 10 wherein the flywheel is mounted between a first fork and a second fork of the fork assembly, the flywheel having a radius of about 430 millimeters and the brake pad defining a radius matching the flywheel radius.

18. The exercise bicycle of claim 17 wherein: the first fork includes a first bracket defining a first channel with a first opening for receiving and supporting an axle of the flywheel, the second fork includes a second bracket defining a second channel with a second opening for receiving and supporting the axle of the flywheel, the first and second openings facing forwardly relative to the exercise bicycle, and the first and second channels orientated transverse to the respective first and second forks such that the axle is gravitationally biased away from the respective first and second openings; and the brake pad is pivotally coupled with the brake arm such that the brake pad may be pivoted so that the flywheel axle may be positioned in the first and second channels.

* * * * *